US010514010B2

(12) United States Patent
Tani et al.

(10) Patent No.: US 10,514,010 B2
(45) Date of Patent: Dec. 24, 2019

(54) FUEL LEVEL ESTIMATION DEVICE AND ABNORMALITY DIAGNOSTIC APPARATUS FOR CLOSED FUEL VAPOR SYSTEM

(71) Applicant: HONDA MOTOR CO., LTD., Tokyo (JP)

(72) Inventors: Michinori Tani, Wako (JP); Hiroki Ishikawa, Wako (JP); Daijiro Nakamura, Wako (JP); Yuichiro Murata, Wako (JP); Ikue Habu, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/162,893

(22) Filed: Oct. 17, 2018

(65) Prior Publication Data

US 2019/0120191 A1 Apr. 25, 2019

(30) Foreign Application Priority Data

Oct. 20, 2017 (JP) ..... 2017-203249

(51) Int. Cl.

| | |
|---|---|
| ***F02M 1/00*** | (2006.01) |
| ***F02M 63/02*** | (2006.01) |
| ***F02D 33/00*** | (2006.01) |
| ***F02M 37/00*** | (2006.01) |

(52) U.S. Cl.

CPC ..... *F02M 63/0205* (2013.01); *F02D 33/003* (2013.01); *F02M 37/0023* (2013.01); *F02M 37/0082* (2013.01); *F02M 37/0088* (2013.01); *F02B 2275/14* (2013.01); *F02M 37/0017* (2013.01)

(58) Field of Classification Search

CPC ..... G01F 23/246; G01F 25/0061; G01F 25/0069; G01K 13/00; B60K 15/03006; B60K 2015/03256; B60K 2015/03368; B60K 2015/03019; B60K 2015/03197; B60K 2015/03217; F02M 25/08

USPC ..... 701/114; 123/516, 518, 520; 73/292

See application file for complete search history.

(56) References Cited

U.S. PATENT DOCUMENTS

| | | | | |
|---|---|---|---|---|
| 9,732,706 | B2 * | 8/2017 | Dudar | F02M 25/0836 |
| 2011/0226352 | A1 * | 9/2011 | Kaneko | B60K 15/03519 137/455 |
| 2018/0038320 | A1 * | 2/2018 | Waples | B60K 15/03504 |

FOREIGN PATENT DOCUMENTS

| | | | |
|---|---|---|---|
| JP | 2007-010574 | A | 1/2007 |

* cited by examiner

*Primary Examiner* — John Kwon

(74) *Attorney, Agent, or Firm* — Rankin, Hill & Clark LLP

(57) ABSTRACT

Disclosed is a fuel level estimation device including: an information acquiring unit acquiring information about a closed system internal pressure of a closed fuel vapor system including the fuel tank, a vent passage, and a canister; a flow rate controlling unit controlling, by actuating a negative pressure pump, a flow rate of fuel vapor-containing gas in the closed fuel vapor system; a fuel level estimating unit estimating a fuel level based on a total volume of the closed fuel vapor system and an occupied volume of the gas. The fuel level estimating unit estimates the occupied volume of the gas by using a change in a closed system internal pressure before and after the closed fuel vapor system is subjected to pressure-reducing treatment for a predetermined interval and a reference discharging rate when the gas is subject to the pressure-reducing treatment. An abnormality diagnostic apparatus is also disclosed.

3 Claims, 10 Drawing Sheets

AT NORMAL TIME

AT TIME OF DIAGNOSING ABNORMALITY

FUEL LEVEL DETECTION VALUE LVls (L)
LVls_h
LVls_l

CLOSED SYSTEM INTERNAL PRESSURE Pit
[CHARACTERISTIC DIFFERENCE WITH RESPECT TO ATMOSPHERIC PRESSURE (mmHg)]
P1
P2
Patm : ATMOSPHERIC PRESSURE
ΔP2
Pref : REFERENCE PRESSURE
Δt
SVth2
SV1
SV1 : FIRST ESTIMATION VALUE
SVth1
SVth : PERMISSIBLE VOLUME RANGE CLOSED SYSTEM SPACE VOLUME SVtg (m3)

DIAGNOSTIC RESULT
OK
RESERVED
NG
OK
t11
t12
t13
t14

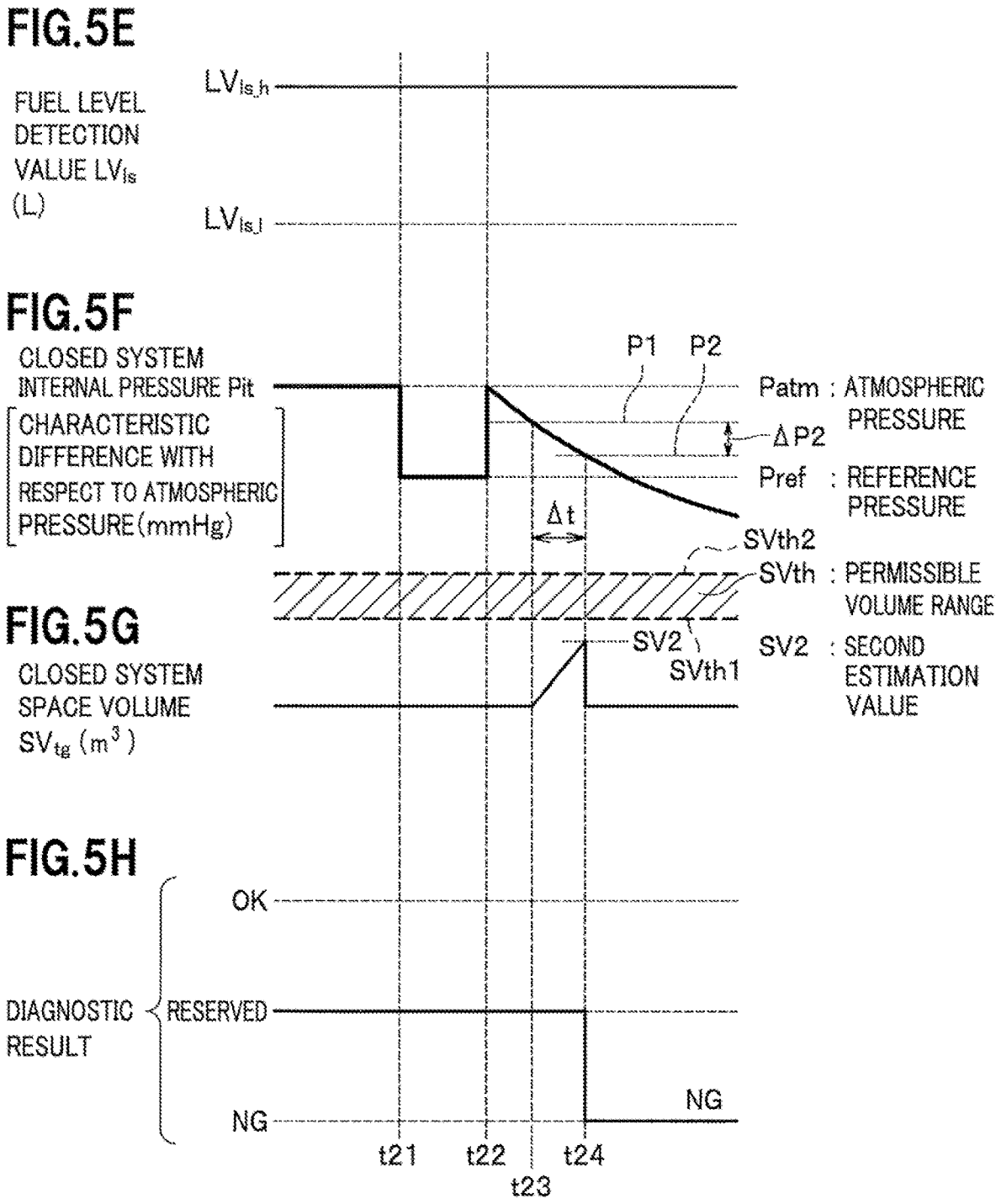
FIG.5E
FUEL LEVEL DETECTION VALUE LVls (L)
LVls_h
LVls_l
FIG.5F
CLOSED SYSTEM INTERNAL PRESSURE Pit
[CHARACTERISTIC DIFFERENCE WITH RESPECT TO ATMOSPHERIC PRESSURE (mmHg)]
P1
P2
Patm : ATMOSPHERIC PRESSURE
ΔP2
Pref : REFERENCE PRESSURE
Δt
SVth2
SVth : PERMISSIBLE VOLUME RANGE
FIG.5G
CLOSED SYSTEM SPACE VOLUME SVtg (m3)
SV2
SVth1
SV2 : SECOND ESTIMATION VALUE
FIG.5H
DIAGNOSTIC RESULT
OK
RESERVED
NG
NG
t21
t22
t23
t24

FUEL LEVEL ESTIMATION DEVICE AND ABNORMALITY DIAGNOSTIC APPARATUS FOR CLOSED FUEL VAPOR SYSTEM

CROSS REFERENCE TO RELATED APPLICATION

This application claims the priority of Japanese Patent Application No. 2017-203249, filed on Oct. 20, 2017 in the Japan Patent Office, the entire specification, claims and drawings of which are incorporated herewith by reference.

TECHNICAL FIELD

The present invention relates to a fuel level estimation device configured to estimate a level of fuel in a fuel tank and an abnormality diagnostic apparatus for a closed fuel vapor system.

BACKGROUND ART

Each vehicle carrying an internal-combustion engine has a fuel tank that stores fuel. The fuel tank is provided with a fuel level sensor that detects a level of fuel therein. Once the fuel level sensor malfunctions, it is impossible to detect a fuel level. This causes troubles for vehicle normal operation.

Then, JP2007-10574A discloses an invention of a trouble diagnostic device configured to diagnose troubles of a fuel level gage that detects a fuel level. This trouble diagnostic device calculates a fuel consumption by integrating fuel injection amounts that have been injected from a fuel injection valve; and when the fuel injection amount integrated value does not correlate to a fuel level gage output (change in fuel level), the fuel level gage is diagnosed to have a malfunction.

This trouble diagnostic device can accurately diagnose a malfunction of the fuel level gage.

CITATION LIST

Patent Literature

[Patent Literature 1] Japanese Patent Application Publication No. 2007-10574

SUMMARY OF INVENTION

Technical Problem

Unfortunately, the trouble diagnostic device according to JP2007-10574A needs some measure such as appropriately grasping a refueling timing and resetting a fuel injection amount integrated value at the time of refueling so as to accurately diagnose a malfunction of the fuel level gage.

The present invention has been made in light of the above situations. The purpose of the present invention is to provide a fuel level estimation device that can estimate, with high precision, a level of fuel in a fuel tank regardless of refueling.

In addition, another purpose of the present invention is to provide an abnormality diagnostic apparatus for a closed fuel vapor system, which apparatus can estimate, with high precision, a level of fuel in a fuel tank regardless of refueling and, at the same time, accurately diagnose an abnormality of a fuel level sensor.

Solution to Problem

To achieve the above objective, the invention according to item (1) is mainly characterized by fuel level estimation device comprising:

an information acquiring unit configured to acquire information about a closed system internal pressure of a closed fuel vapor system including a fuel tank that stores fuel, a vent passage through which the fuel tank is in communication with air, and a canister used to adsorb fuel vapor generated in the fuel tank;

a flow rate controlling unit configured to control, by actuating a negative pressure source, a flow rate of fuel vapor-containing gas present in the closed fuel vapor system; and a fuel level estimating unit configured to estimate a fuel level based on a total volume of the closed fuel vapor system and an occupied volume of the gas, wherein the fuel level estimating unit estimates the occupied volume of the gas on the basis of a change in the closed system internal pressure before and after the closed fuel vapor system is subjected to pressure-reducing treatment for a predetermined unit time by means of the flow rate controlling unit and a reference discharging rate when the gas is subject to the pressure-reducing treatment.

In the invention according to item (1), the fuel level estimating unit estimates the occupied volume of the fuel vapor-containing gas present in the closed fuel vapor system on the basis of a change in the closed system internal pressure before and after the closed fuel vapor system is subjected to pressure-reducing treatment for a predetermined unit time by means of the flow rate controlling unit and a reference discharging rate when the gas is subject to the pressure-reducing treatment. Further, the fuel level estimating unit estimates a fuel level based on the total volume of the closed system and the occupied volume of the gas.

Advantageous Effects of Invention

According to the present invention, a fuel level can be estimated based on a total volume of a closed fuel vapor system and an occupied volume of fuel vapor-containing gas present in the closed fuel vapor system. This makes it possible to estimate, with high precision, the level of fuel in a fuel tank regardless of refueling.

BRIEF DESCRIPTION OF DRAWINGS

FIGS. 5E to 5H are time charts showing the time course of each value in the case where it is determined that the fuel level sensor is abnormal when the fuel level detection value is a value corresponding to the insensitive region at the full liquid level.

DESCRIPTION OF EMBODIMENTS

Figure 1A:
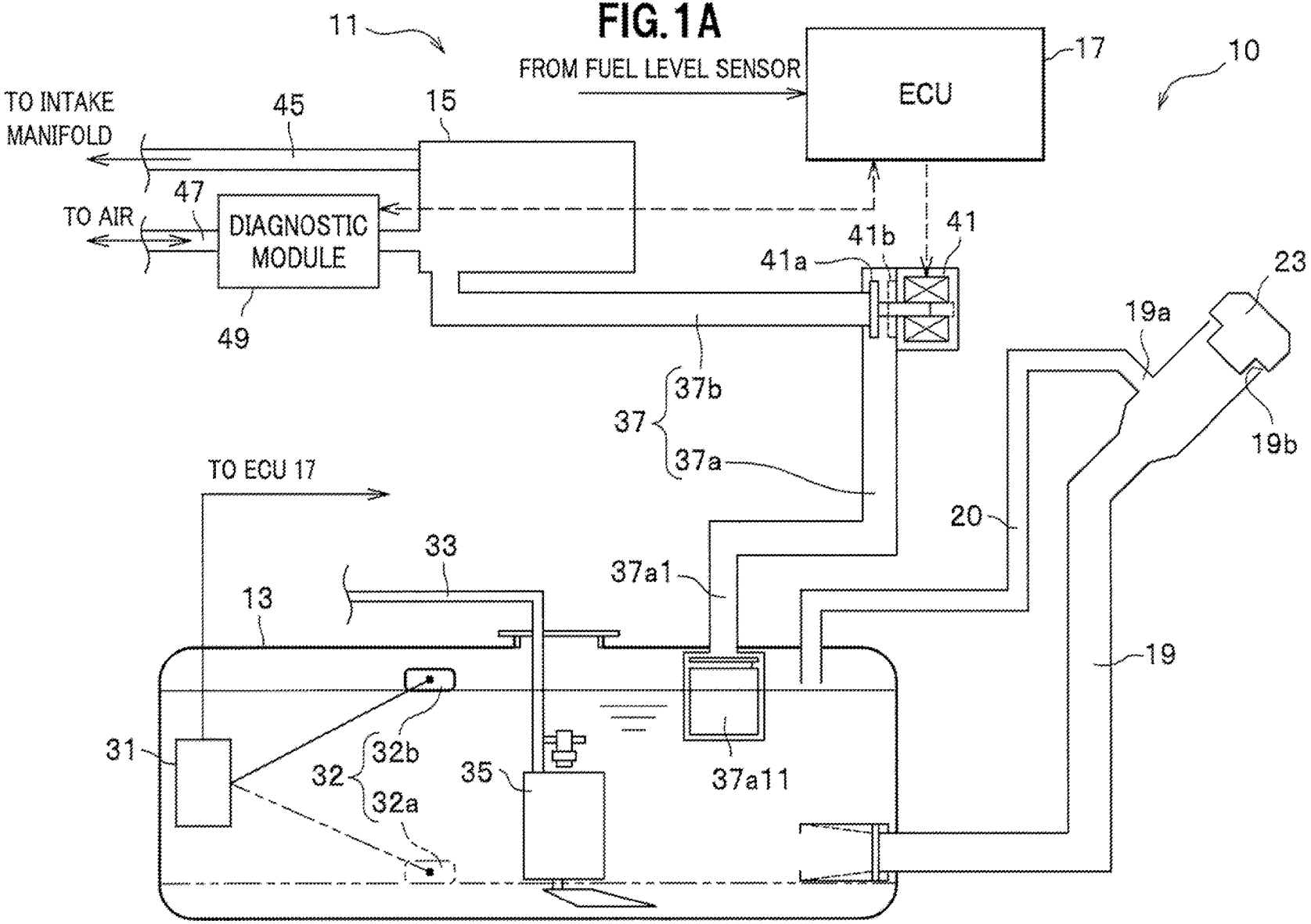
FIG. 1A shows a schematic general configuration of an abnormality diagnostic apparatus for a closed fuel vapor system, including a fuel level estimation device according to an embodiment of the present invention.

Hereinafter, a fuel level estimation device and an abnormality diagnostic apparatus for a closed fuel vapor system according to embodiments of the present invention are described in detail by appropriately referring to the Drawings.

[Outline of Abnormality Diagnostic Apparatus 10 for Closed Fuel Vapor System According to Embodiment of the Present Invention]

First, an abnormality diagnostic apparatus 10 for a closed fuel vapor system, which apparatus includes a fuel level estimation device 11 according to an embodiment of the present invention, is outlined and illustrated, with reference to the Drawings, by referring to an example applicable to each hybrid vehicle equipped with an internal-combustion engine and an electric motor as driving sources.

Note that in the following figures, the same members or corresponding members have the same reference numerals. In addition, the size and form of each member may be modified or schematically exaggerated for description convenience.

Figure 1B:
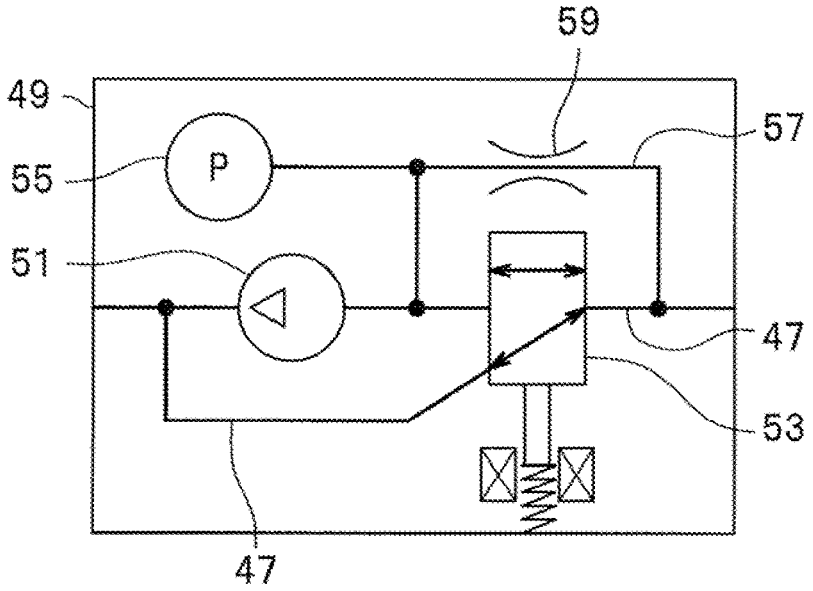
FIG. 1B schematically depicts a configuration of a diagnostic module (at normal time) included in the abnormality diagnostic apparatus.
Figure 1C:
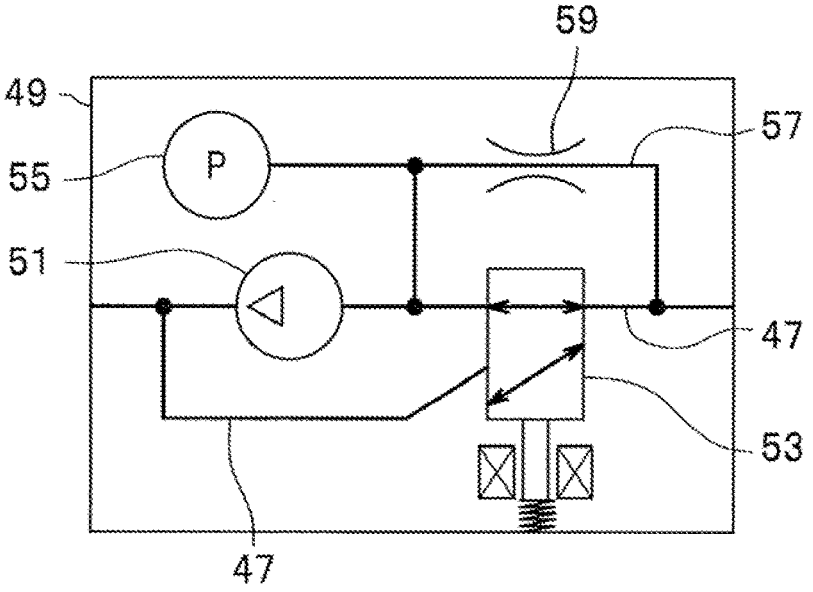
FIG. 1C schematically depicts a configuration of the diagnostic module (at the time of diagnosing an abnormality) included in the abnormality diagnostic apparatus.
Figure 2:
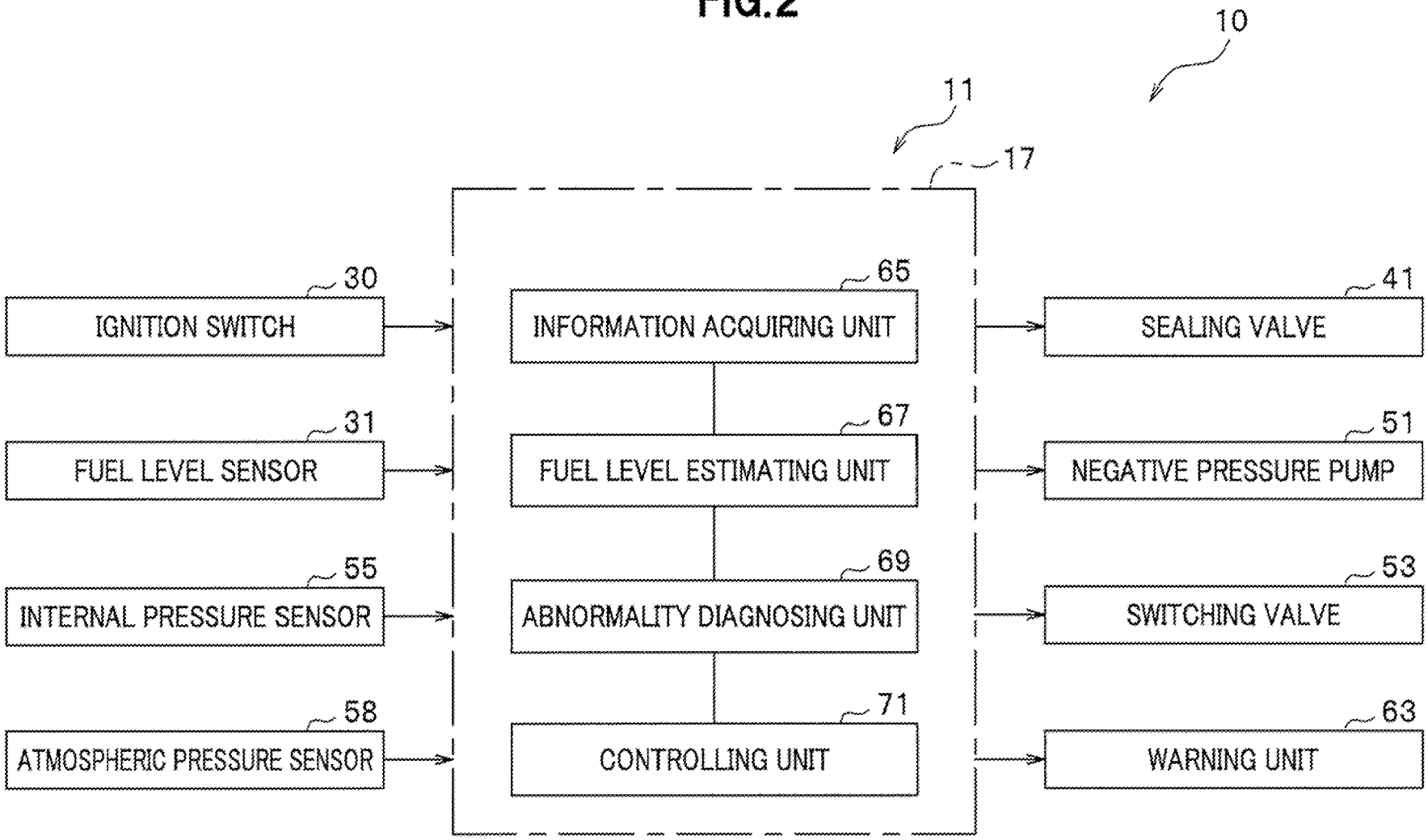
FIG. 2 is a functional block diagram of the abnormality diagnostic apparatus.

FIG. 1A shows a schematic general configuration of the abnormality diagnostic apparatus 10 including the fuel level estimation device 11 according to an embodiment of the present invention. FIG. 1B schematically depicts a configuration of a diagnostic module 49 (at normal time) included in the abnormality diagnostic apparatus 10. FIG. 1C schematically depicts a configuration of the diagnostic module 49 (at the time of diagnosing an abnormality) included in the abnormality diagnostic apparatus 10. FIG. 2 is a functional block diagram of the abnormality diagnostic apparatus 10.

As shown in FIG. 1A, the abnormality diagnostic apparatus 10 for a closed fuel vapor system, which apparatus includes the fuel level estimation device 11 according to an embodiment of the present invention, is applicable to a vehicle including a fuel tank 13 that stores fuel such as gasoline and a canister 15 having a function of adsorbing fuel vapor generated in the fuel tank 13, and is provided with an ECU (Electronic Control Unit) 17 configured to execute integrated control of the abnormality diagnostic apparatus 10 and the fuel level estimation device 11.

The fuel tank 13 has a fuel inlet pipe 19. A circulation pipe 20, through which an upstream portion 19*a* of the fuel inlet pipe 19 is in communication with the fuel tank 13, is installed. A fuel filler port 19*b*, into which the nozzle of a fueling gun (not shown) can be inserted, is provided to the fuel inlet pipe 19 on a side opposite to the fuel tank 13 side. A screw cap 23 is attached to the fuel filler port 19*b*.

As shown in FIG. 1A, the fuel tank 13 is provided with a fuel level sensor 31 that detects a level of fuel therein. The fuel level sensor 31 is equipped with a float 32 that moves up and down in accordance with a change in the liquid level of fuel in the fuel tank 13. The float 32 swings while moving up and down between the minimum liquid level 32*a*, which indicates a refueling need, and the full liquid level 32*b*, which corresponds to the designed maximum liquid level.

The reason why the wording "designed maximum liquid level" is used herein is based on the fact that even after fuel reaches the full liquid level 32*b*, refueling may be allowed continuously depending on an attitude angle of a vehicle, etc.

Note that the minimum liquid level 32*a* and the full liquid level 32*b* are liquid levels at which the float 32 of the fuel level sensor 31 is positioned when their values correspond to insensitive regions (see FIG. 4) where a fuel level detection value $LV_{ls}$ of the fuel level sensor 31 does not follow a change in an actual fuel level $V_{ft}$ and both are different. The insensitive regions are described in detail below.

Further, the fuel tank 13 is provided with a fuel pump module 35 configured to pump fuel stored in the fuel tank 13 and transfer the fuel, via a fuel supply passage 33, to an injector (not shown). Furthermore, the fuel tank 13 is provided with a vent passage 37 through which the fuel tank 13 is in communication with the canister 15. The vent passage 37 functions as a discharge passage for fuel vapor.

A passage 37*a*1 of the vent passage 37 on the fuel tank 13 side has a float valve 37*a*11. The float valve 37*a*11 is closed when a pressure (tank internal pressure) of a gas phase area in the fuel tank 13 increases after the fuel liquid level raises due to refueling. Specifically, because the float valve 37*a*11 is closed while the fuel tank 13 is fully filled with fuel, the fuel can be prevented from discharging from the fuel tank 13 to the vent passage 37.

A sealing valve 41 is provided partway through the vent passage 37.

Note that in the following description, the vent passage 37 on the fuel tank 13 side when the sealing valve 41 is defined as a boundary refers to a first vent passage 37*a*; and the vent passage 37 on the canister 15 side when the sealing valve 41 is defined as the boundary refers to a second vent passage 37*b*. In addition, the first and second vent passages 37*a* and 37*b* are generally and simply referred to as the vent passage 37.

The sealing valve 41 can function to shut an internal space of the fuel tank 13 off from the air (see the reference sign 41*a* of FIG. 1A indicating a closed state) or to cause the internal space to be in communication with the air (see the reference sign 41*b* of FIG. 1A indicating an open state). Specifically, the sealing valve 41 is a normally closed solenoid valve that can be actuated in accordance with an open/close command signal sent from the ECU 17. The sealing valve 41 can be actuated to shut the internal space of the fuel tank 13 off from air or to cause the internal space to be in communication with the air in accordance with the above open/close command signal.

The canister 15, which is provided in the second vent passage 37*b*, has a built-in adsorbent (not shown) composed of active carbon so as to adsorb fuel vapor. The adsorbent of the canister 15 can adsorb fuel vapor transferred via the vent passage 37 from the fuel tank 13 side. The canister 15 is connected to and in communication with, in addition to the second vent passage 37*b*, a purge passage 45 and an air injection passage 47. The canister 15 serves to execute purge processing in which intake air from the air injection passage 47, together with fuel vapor adsorbed on the adsorbent of the canister 15, is transferred via the purge passage 45 to an intake manifold.

The purge passage 45 on a side opposite to the canister 15 side is connected to and in communication with the intake manifold (not shown). By contrast, the air injection passage 47 on a side opposite to the canister 15 side is connected to and in communication with air. The air injection passage 47 has the diagnostic module 49.

The diagnostic module 49 is a functional member used at the time of diagnosing a leak of the closed fuel vapor system and an abnormality of the fuel level sensor 31. As shown in FIGS. 1B and 1C, the diagnostic module 49 has an air injection passage 47 and a bypass passage 57 provided in parallel to the air injection passage 47. The air injection passage 47 has a switching valve 53. The switching valve 53 functions to make the canister 15 open to air or shut off from the air. Specifically, the switching valve 53 is a solenoid valve that can be actuated in accordance with a switching signal sent from the ECU 17. In one hand, the switching valve 53 is used to cause the canister 15 to be in communication with air while being in a non-conducting off state (see FIG. 1B). On the other hand, the switching valve 53 is used to make the canister 15 shut off from the air while being in an on state where the switching signal is supplied from the ECU 17 (see FIG. 1C).

Meanwhile, the bypass passage 57 is provided with a negative pressure pump 51, an internal pressure sensor 55, and a reference orifice 59. The negative pressure pump 51 is a fixed discharging pump through which a fixed volume is discharged per unit time. The negative pressure pump 51 functions to discharge, to the air, gas present in the closed fuel vapor system so as to make an internal pressure Pit of the closed fuel vapor system negative to the atmospheric pressure Patm. The negative pressure pump 51 corresponds to a "negative pressure source" of the present invention.

As used herein, the closed fuel vapor system refers to a closed space including the fuel tank 13, the vent passage 37, the sealing valve 41, the canister 15, the air injection passage 47, and the diagnostic module 49. The closed fuel vapor system is configured to include a fuel tank side and a canister side. The fuel tank side provides a closed space from the fuel tank 13 via the first vent passage 37*a* to the sealing valve 41. The canister side provides a closed space from the sealing valve 41 via the second vent passage 37*b* to the canister 15 and further via the air injection passage 47 to the diagnostic module 49. Note that in the following description, the closed spaces of the closed fuel vapor system may be expressed in short as a "closed system space".

The internal pressure sensor 55 functions to detect an internal pressure Pit of the closed fuel vapor system (hereinafter, referred to as a "closed system internal pressure"). Provided that the internal pressure sensor 55 detects the atmospheric pressure Patm in the case where the negative pressure pump 51 does not suck gas while the switching valve 53 is switched to the air communication side (see FIG. 1B) so as to cause the canister 15 to be in communication with the air.

Figures 5A, 5B, 5C, 5D:
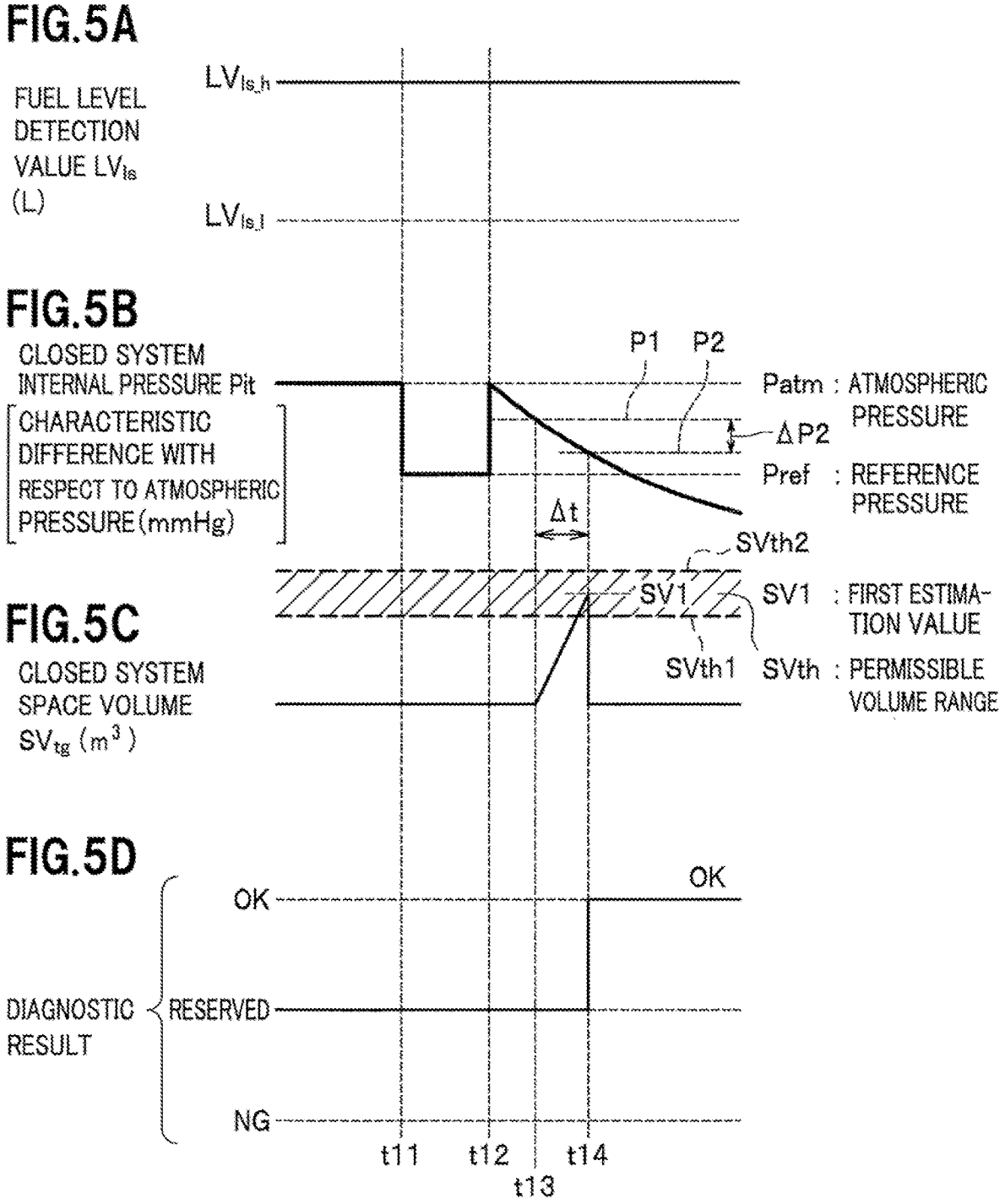
FIGS. 5A to 5D are time charts showing the time course of each value in the case where it is determined that the fuel level sensor is normal when the fuel level detection value is a value corresponding to an insensitive region at a full liquid level.

In addition, in the case where while the switching valve 53 is switched to the air communication side, the negative pressure pump 51 sucks gas through the reference orifice 59, the internal pressure sensor 55 detects a reference pressure Pref, which is less than the atmospheric pressure Patm (see, for example, FIG. 5B). The reference pressure Pref converges on the same negative-pressure value as in the case where while a leak hole having the same diameter as the hole diameter of the reference orifice 59 is open in the vent passage 37, the negative pressure pump 51 sucks gas.

This converged detection value (negative-pressure value) of the internal pressure sensor 55 is stored, as a leak determination threshold, in a nonvolatile memory (not shown) included in the ECU 17. The leak determination threshold is used as a reference when it is diagnosed whether or not a leak hole having a size larger than the hole diameter d of the reference orifice 59 is open in the closed fuel vapor system. Note that the hole diameter d of the reference orifice 59 is set to an appropriate value in view of the diameter of the leak hole being diagnosed.

Further, the internal pressure sensor 55 detects the closed system internal pressure Pit in the case where while the switching valve 53 is switched to the air shut-off side such that the canister 15 is shut off from the air (see FIG. 1C), the sealing valve 41 is opened (see the reference sign 41*b* of FIG. 1A indicating an open state) to cause the fuel tank 13 to be in communication with the canister 15 via the vent passage 37. In this case, the closed system internal pressure Pit is equal to the internal pressure of the vent passage 37, the internal pressure of the fuel tank 13, and the internal pressure of the canister 15. Information about the closed system internal pressure Pit detected by the internal pressure sensor 55 is sent to the ECU 17.

The reference orifice 59 is used at the time of setting the leak determination threshold for determining whether or not there is a leak when the leak of the closed fuel vapor system is diagnosed. In addition, the reference orifice 59 is used at the time of calculating, before an abnormality of the fuel level sensor 31 is diagnosed, a reference discharging rate Qref.

As used herein, the reference discharging rate Qref is a value (L/sec) estimated for the gas flow rate caused when the pressure of the closed system space is reduced by using the negative pressure pump 51. As the reference discharging rate Qref, it is possible to use a discharging rate when gas present in the closed system space is actually sucked through the reference orifice 59 by using the negative pressure pump 51. Note that the reference discharging rate Qref has a linear positive correlation with the closed system internal pressure Pit. Because of this, it is possible to appropriately select, as the reference discharging rate Qref, a value corrected in accordance with a change in the closed system internal pressure Pit.

How to calculate the reference discharging rate Qref is described in detail below.

As shown in FIG. 2, the following respective members are connected to the ECU 17 that serves as a "control unit" of the present invention, including, as an input system, an ignition switch 30, the fuel level sensor 31, the internal pressure sensor 55, and an atmospheric pressure sensor 58 that detects the atmospheric pressure Patm. Information about the atmospheric pressure detected by the atmospheric pressure sensor 58 is sent to the ECU 17.

In addition, as shown in FIG. 2, the following respective members are connected to the ECU 17, including, as an output system, the sealing valve 41, the negative pressure pump 51, the switching valve 53, and a warning unit 63. The warning unit 63 functions to inform of information about diagnosis of a leak of the closed fuel vapor system and diagnosis of an abnormality of the fuel level sensor 31. Specifically, as the warning unit 63, it is preferable to use a display unit (not shown) such as a liquid crystal display installed in a vehicle cabin and/or an audio output unit such as a speaker.

The ECU 17, as shown in FIG. 2, is configured to include an information acquiring unit 65, a fuel level estimating unit 67, an abnormality diagnosing unit 69, and a controlling unit 71.

The ECU 17 is provided with a microcomputer including a CPU (Central Processing Unit), a ROM (Read Only Memory), and a RAM (Random Access Memory). This microcomputer reads and runs data and programs stored in the ROM and then executes control of various functions including: an information acquiring function, a fuel level estimating function, and a fuel level sensor 31 abnormality diagnosing function of the ECU 17 and an integrated control function for the entire abnormality diagnostic apparatus 10 and fuel level estimation device 11.

The information acquiring unit 65 functions to acquire information about a fuel level detection value $LV_{ls}$ detected by the fuel level sensor 31, pressure information about the closed system internal pressure Pit detected by the internal pressure sensor 55, and information about the atmospheric pressure detected by the atmospheric pressure sensor 58.

The fuel level estimating unit 67 functions to estimate a level $V_{fl}$ of fuel in the fuel tank 13. Specifically speaking, the fuel level estimating unit 67 can estimate the fuel level $V_{fl}$ based on a whole closed system volume $SV_{wl}$ and an occupied volume of fuel vapor-containing gas present in the closed fuel vapor system. This is based on the calculation in which the occupied volume of fuel vapor-containing gas present in the closed fuel vapor system is subtracted from the whole closed system volume $SV_{wl}$, which is a total volume of the closed system, to give a fuel level $V_{fl}$, namely an occupied volume of fuel in the fuel tank 13.

Among them, the whole closed system volume $SV_{wl}$ may be obtained based on the specification of the closed fuel vapor system.

In addition, the occupied volume of fuel vapor-containing gas present in the closed fuel vapor system may be calculated by the following protocol.

Specifically, the fuel level estimating unit 67 can estimate the closed system space volume $SV_{tg}$ based on the reference discharging rate Qref (described in detail below) and a second pressure difference ΔP2 (=P1−P2; see, for instance, FIG. 5B), which is a difference in the closed system internal pressure Pit before and after gas present in the closed system space is subjected to pressure-reducing treatment for a predetermined unit time Δt (=|t13−t14|; see, for instance, FIG. 5B) by means of the negative pressure pump 51. Note that how to estimate the closed system space volume $SV_{tg}$ is described in detail below.

As used herein, the "closed system space volume $SV_{tg}$" means an occupied volume of fuel vapor-containing gas present in the closed fuel vapor system. Then, the "occupied volume of fuel vapor-containing gas present in the closed fuel vapor system" is sometimes called the "closed system space volume $SV_{tg}$".

Next, the fuel level estimating unit 67 estimates an occupied volume of fuel in the fuel tank 13, namely a fuel level $V_{fl}$, by subtracting the closed system space volume $SV_{tg}$ from the whole closed system volume $SV_{wl}$ (i.e., $SV_{wl}-SV_{tg}$). The fuel level estimation value $LV_{es}$ as so obtained is referred to when the abnormality diagnosing unit 69 diagnoses an abnormality of the fuel level sensor 31.

The abnormality diagnosing unit 69 functions to diagnose a leak of the closed fuel vapor system and diagnose an abnormality of the fuel level sensor 31.

Specifically speaking, the abnormality diagnosing unit 69 diagnoses a leak of the closed fuel vapor system after the sealing valve 41 is opened (see the reference sign 41*b* of FIG. 1A indicating an open state) and the switching valve 53 is switched to cause the canister 15 to be shut off from the air (see FIG. 1C).

The abnormality diagnosing unit 69 can diagnose a leak of the closed fuel vapor system on the basis of whether or not the closed system internal pressure Pit when the closed fuel vapor system is negatively pressurized almost in vacuum by actuating the negative pressure pump 51 reaches a negative-pressure value lower than the reference pressure Pref (see, for example, FIG. 5B) with respect to the atmospheric pressure Patm.

Specifically, the abnormality diagnosing unit 69 diagnoses that there is a leak if the closed system internal pressure Pit when the closed fuel vapor system is negatively pressurized to a predetermined pressure such as almost in vacuo fails to reach a negative-pressure value lower than the reference pressure Pref (see, for example, FIG. 5B) with respect to the atmospheric pressure Patm. By contrast, the abnormality diagnosing unit 69 diagnoses that there is no leak if the closed system internal pressure Pit when the closed fuel vapor system is negatively pressurized almost in vacuum reaches a negative-pressure value lower than the reference pressure Pref with respect to the atmospheric pressure Patm.

This is based on the fact that in the case where there is no leak in the closed fuel vapor system, it never happens that the closed system internal pressure Pit when the closed fuel vapor system is negatively pressurized to the predetermined pressure fails to reach a negative pressure value lower than the reference pressure Pref because the Pit does certainly reach the negative pressure value lower than the reference pressure Pref.

Meanwhile, like diagnosing a leak of the closed fuel vapor system, the abnormality diagnosing unit 69 can diagnose an abnormality of the fuel level sensor 31 after the sealing valve 41 is opened (see the reference sign 41*b* of FIG. 1A indicating an open state) and the switching valve 53 is switched to cause the canister 15 to be shut off from the air (see FIG. 1C).

The abnormality diagnosing unit 69 can diagnose an abnormality of the fuel level sensor 31 on the basis of whether or not the absolute value ($|V_{ls}-LV_{es}|$) of the difference between the fuel level detection value $LV_{ls}$ detected by the fuel level sensor 31 and the fuel level estimation value $LV_{es}$ obtained by the fuel level estimating unit 67 is less than a predetermined permissible error threshold $LV_{th}$. The permissible error threshold $LV_{th}$ may be set to an appropriate value while it is determined that the fuel level sensor 31 is abnormal if the fuel level detection value $LV_{ls}$ disagrees with the actual fuel level $V_{fl}$.

Specifically, the abnormality diagnosing unit 69 diagnoses that the fuel level sensor 31 is not abnormal if the absolute value of the difference ($|LV_{ls}-LV_{es}|$) is less than the permissible error threshold $LV_{th}$. By contrast, the abnormality diagnosing unit 69 diagnoses that the fuel level sensor 31 is abnormal if the absolute value of the difference ($|LV_{ls}-LV_{es}|$) is equal to or larger than the permissible error threshold $LV_{th}$.

This is based on the fact that in the case where the fuel level sensor 31 is normal (without any abnormality), it never happens that the absolute value of the difference ($|LV_{ls}-LV_{es}|$) is equal to or larger than the permissible error threshold $LV_{th}$ because the absolute value is substantially smaller than the permissible error threshold $LV_{th}$.

The controlling unit 71 functions to execute, during stoppage of an internal-combustion engine, an open command to open the sealing valve 41 and a shut-off command to shut off the switching valve 53. In addition, the controlling unit 71 functions to control a flow rate of fuel vapor-containing gas present in the closed fuel vapor system by actuating the negative pressure pump (negative pressure source) 51.

[How to Operate Abnormality Diagnostic Apparatus 10 for Closed Fuel Vapor System, Including Fuel Level Estimation Device 11 According to Embodiment of the Present Invention]

Figure 3:
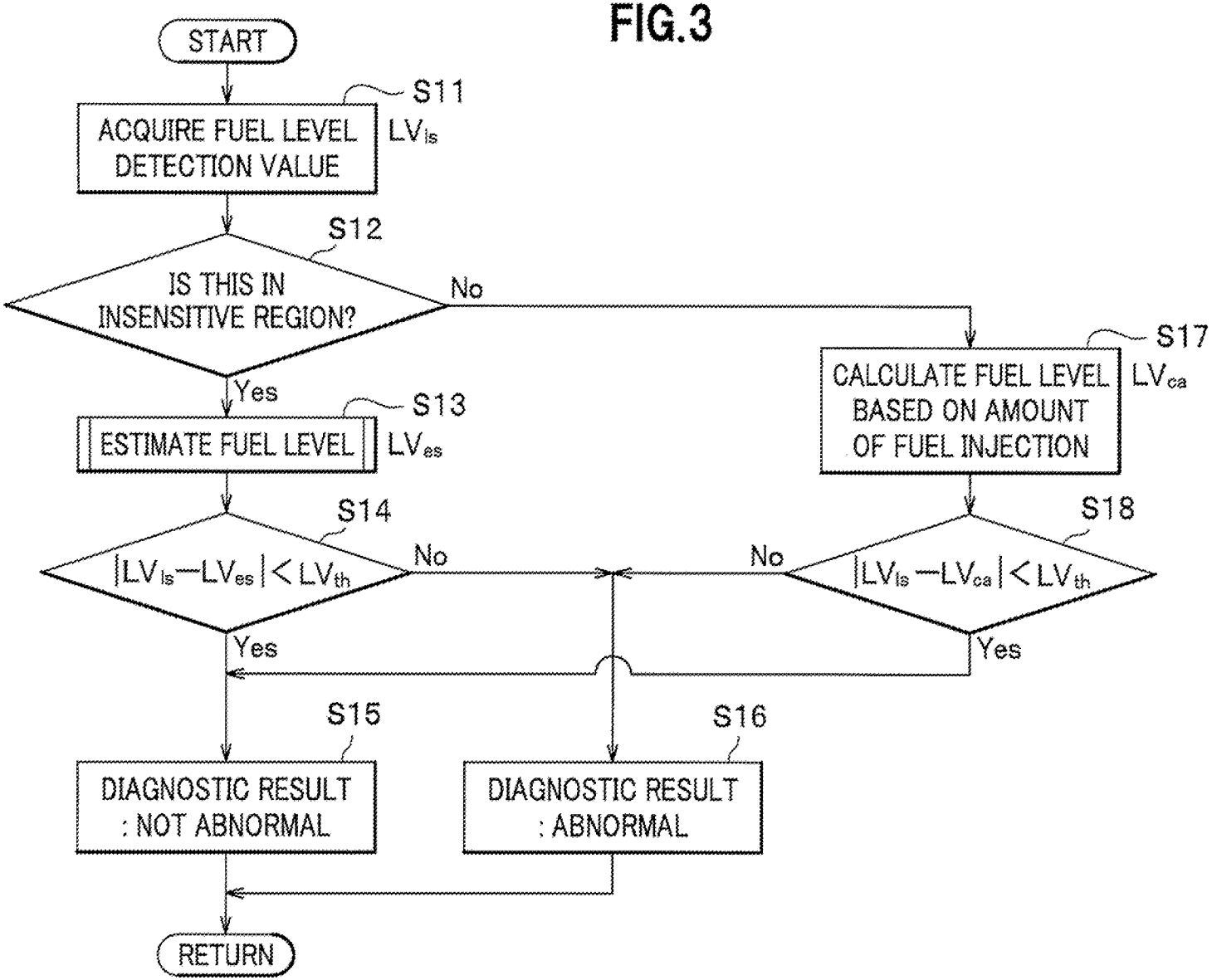
FIG. 3 is a flow chart illustrating a flow of fuel level sensor abnormality diagnostic processing executed by the abnormality diagnostic apparatus.
Figure 4:
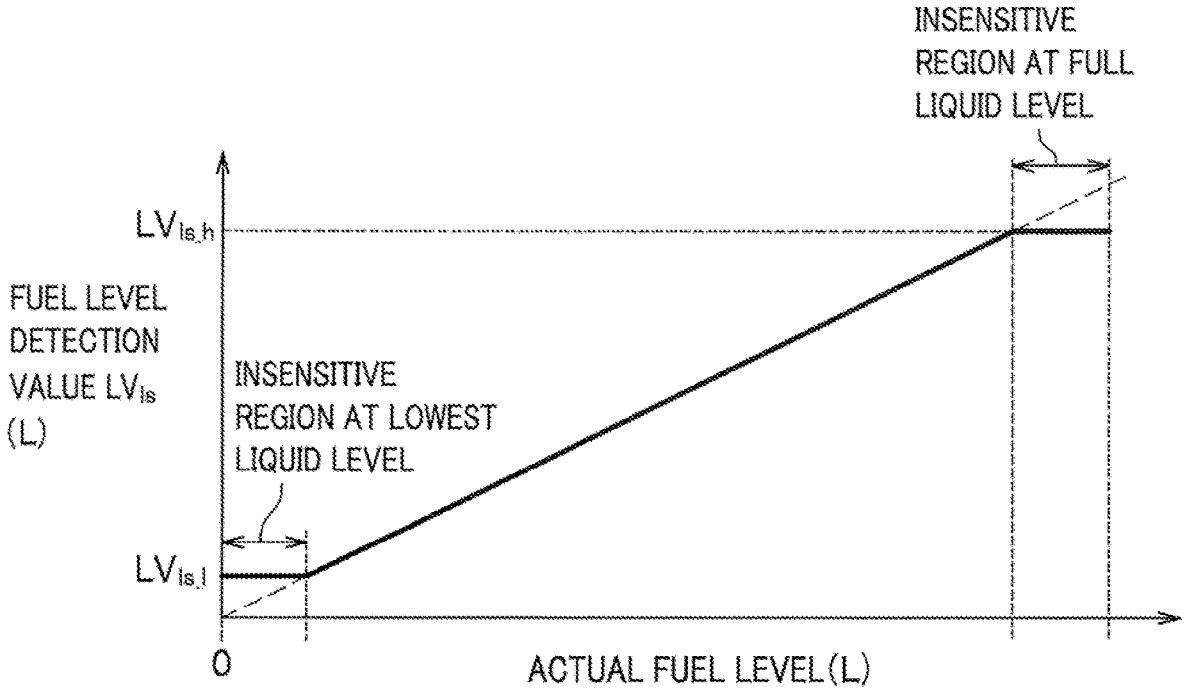
FIG. 4 is a graph illustrating that a fuel level detection value detected by the fuel level sensor has insensitive regions where the detection value disagrees with an actual fuel level.

With reference to FIGS. 3 and 4, the following describes how to operate the abnormality diagnostic apparatus 10 for the closed fuel vapor system, including the fuel level estimation device 11 according to an embodiment of the present invention.

FIG. 3 is a flow chart illustrating a flow of fuel level sensor 31 abnormality diagnostic processing executed by the abnormality diagnostic apparatus 10. FIG. 4 is a graph illustrating that the fuel level detection value $LV_{ls}$ has insensitive regions where the detection value disagrees with an actual fuel level $V_{fl}$.

Note that FIG. 3 shows the case where abnormality diagnostic processing is executed during traveling of a vehicle while the ignition switch 30 is on.

In addition, the states of the sealing valve 41 and the switching valve 53 during the abnormality diagnostic processing are set such that while the sealing valve 41 is open (see reference sign 41*b* of FIG. 1A indicating an open state), the switching valve 53 is in a shut-off state where the canister 15 is shut off from the air (see FIG. 1C).

In the abnormality diagnostic processing, whether or not the fuel level sensor 31 works normally is diagnosed. Examples of a possible situation where the fuel level sensor 31 is diagnosed as abnormal include: an abnormal case where the fuel level detection value $LV_{ls}$ detected by the fuel level sensor 31 is a fixed value; and an abnormal case where the fuel level detection value $LV_{ls}$ disagrees with an actual fuel level $V_{fl}$.

In this abnormality diagnostic processing, the level $V_{fl}$ of fuel in the fuel tank 13 is estimated with high precision regardless of refueling. Here, when the suction (gas discharging rate) by the negative pressure pump 51 is assumed to be constant due to fixed flow rate control and the negative pressure pump 51 is used to subject the closed fuel vapor system to pressure-reducing treatment for a predetermined unit time, the closed system space volume $SV_{tg}$ can be estimated based on information about a change in the closed system internal pressure Pit before and after the pressure-reducing treatment and the reference discharging rate when the gas is subject to the pressure-reducing treatment.

In Step S11 of FIG. 3, the information acquiring unit 65 of the ECU 17 acquires a fuel level detection value $LV_{ls}$ detected by the fuel level sensor 31.

In Step S12, the ECU 17 determines whether or not the fuel level detection value $LV_{ls}$ as obtained in Step S11 is a value corresponding to an insensitive region where the $LV_{ls}$ does not follow an actual change in the fuel level $V_{fl}$ and both are thus different.

The floating fuel level sensor 31 can detect a level of fuel in the fuel tank 13 by determining a float 32 position while the float moves up and down. Here, what is called an insensitive region, where the fuel level detection value $LV_{ls}$ does not follow a change in an actual fuel level $V_{fl}$ and both are thus different as shown in FIG. 4, is present and corresponds to each of the minimum liquid level 32*a* and the full liquid level 32*b* for the float 32.

For the description purpose, the lowest fuel level detection value $LV_{ls}$ refers to a fuel level detection value corresponding to the insensitive region according to the minimum liquid level 32*a*; and the full fuel level detection value $LV_{ls_h}$ refers to a fuel level detection value corresponding to the insensitive region according to the full liquid level 32*b*.

If the determination result of Step S12 shows that it is determined that the fuel level detection value $LV_{ls}$ is a value corresponding to the insensitive region indicating either the minimum liquid level 32*a* or the full liquid level 32*b* (Yes), the ECU 17 advances the process flow to next Step S13.

By contrast, if the determination result of Step S12 shows that it is determined that the fuel level detection value $LV_{ls}$ is not a value corresponding to the insensitive region indicating either the minimum liquid level 32*a* or the full liquid level 32*b* (No), the ECU 17 makes the process flow jump to Step S17.

In Step S13, the fuel level estimating unit 67 of the ECU 17 uses the whole closed system volume $SV_{wl}$ and an occupied volume (closed system space volume $SV_{tg}$) of fuel vapor-containing gas present in the closed fuel vapor system and then subtracts the closed system space volume $SV_{tg}$ from the whole closed system volume $SV_{wl}$ (i.e., $SV_{wl}-SV_{tg}$) to estimate an occupied volume of fuel in the fuel tank 13, namely the fuel level $V_{fl}$. By doing so, the fuel level estimating unit 67 of the ECU 17 can obtain the fuel level estimation value $LV_{es}$.

Note that how to estimate the closed system space volume $SV_{tg}$ is described in detail below.

In Step S14, the abnormality diagnosing unit 69 of the ECU 17 diagnoses an abnormality of the fuel level sensor 31 on the basis of whether or not the absolute value ($|LV_{ls}-LV_{es}|$) of the difference between the fuel level detection value $LV_{ls}$ obtained in Step S11 and the fuel level estimation value $LV_{es}$ obtained in Step S13 is less than the permissible error threshold $LV_{th}$.

If the result of the abnormality diagnosis in Step S14 shows that the absolute value of the difference ($|LV_{ls}-LV_{es}|$) is less than the permissible error threshold $LV_{th}$ (Yes), the abnormality diagnosing unit 69 of the ECU 17 diagnoses, in Step S15, that the fuel level sensor 31 is not abnormal, and the process flow is ended.

By contrast, if the result of the abnormality diagnosis in Step S14 shows that the absolute value of the difference ($|LV_{ls}-LV_{es}|$) is equal to or larger than the permissible error threshold $LV_{th}$ (No), the abnormality diagnosing unit 69 of the ECU 17 diagnoses, in Step S16, that the fuel level sensor 31 is abnormal, and the process flow is ended.

Meanwhile, if the determination result of Step S12 shows that it is determined that the fuel level detection value $LV_{ls}$ is not a value corresponding to the insensitive region indicating either the minimum liquid level 32*a* or the full liquid level 32*b*, the ECU 17 calculates a fuel level $V_{fl}$ based on an amount of fuel injection in Step S17. By doing so, the ECU 17 can obtain a fuel level calculation value $LV_{ca}$. Known technologies disclosed in, for example, JP2007-10574A may be suitably applicable to a procedure for calculating the fuel level $V_{fl}$ based on the amount of fuel injection.

In Step S18, the abnormality diagnosing unit 69 of the ECU 17 diagnoses an abnormality of the fuel level sensor 31 on the basis of whether or not the absolute value ($|LV_{ls}-LV_{ca}|$) of the difference between the fuel level calculation value $LV_{ls}$ obtained in Step S11 and the fuel level calculation value $LV_{ca}$ obtained in Step S17 is less than the permissible error threshold $LV_{th}$.

If the result of the abnormality diagnosis in Step S18 shows that the absolute value of the difference ($|LV_{ls}-LV_{ca}|$) is less than the permissible error threshold $LV_{th}$ (Yes), the abnormality diagnosing unit 69 of the ECU 17 diagnoses, in Step S15, that the fuel level sensor 31 is not abnormal, and the process flow is ended.

By contrast, if the result of the abnormality diagnosis in Step S18 shows that the absolute value of the difference ($|LV_{ls}-LV_{ca}|$) is equal to or larger than the permissible error threshold $LV_{th}$ (No), the abnormality diagnosing unit 69 of the ECU 17 diagnoses, in Step S16, that the fuel level sensor 31 is abnormal, and the process flow is ended.

In Steps S17 to S18, an abnormality of the fuel level sensor 31 is diagnosed based on the fuel level detection value $LV_{ls}$ obtained in Step S11 and the fuel level calculation value $LV_{ca}$ obtained in Step S17. This case should require a shorter time for the abnormality diagnosis than the case where an abnormality of the fuel level sensor 31 is diagnosed based on the fuel level detection value $LV_{ls}$ obtained in Step S11 and the fuel level estimation value $LV_{es}$ obtained in Step S13.

[Time Course of Operation of Abnormality Diagnostic Apparatus 10 for Closed Fuel Vapor System According to Embodiment of the Present Invention]

With reference to FIGS. 5A to 5H, the following further describes, in detail, the time courses of operation of the abnormality diagnostic apparatus 10 for the closed fuel vapor system according to an embodiment of the present invention.

FIGS. 5A to 5D are time charts showing the time course of each value in the case where it is determined that the fuel level sensor 31 is normal when the fuel level detection value $LV_{ls}$ is a value corresponding to the insensitive region at the full liquid level 32*b*. FIGS. 5E to 5H are time charts showing the time course of each value in the case where it is determined that the fuel level sensor 31 is abnormal when the fuel level detection value $LV_{ls}$ is a value corresponding to the insensitive region at the full liquid level 32*b*.

Example 1 (Diagnostic Result: Not Abnormal)

First, FIGS. 5A to 5D used to explain the time course of operation in Example 1 (diagnostic result: not abnormal).

Example 1 shows an example in which the fuel level detection value $LV_{ls}$ is a value corresponding to the insensitive region at the full liquid level 32*b*. In short, in Example 1, the fuel level sensor 31 indicates the full fuel level detection value $LV_{ls_h}$.

During a period from t11 to t12 shown in FIGS. 5A to 5D, the reference discharging rate Qref is calculated. During this calculation, the switching valve 53 of the diagnostic module 49 is off and the canister 15 is thus in communication with the air (see FIG. 1B). Under this condition, the negative pressure pump 51 sucks gas. Due to this suction, the internal pressure sensor 55 detects a reference pressure Pref, which is less than the atmospheric pressure Patm (see, for example, FIG. 5B).

The hole diameter d of the reference orifice 59 is known. So, the reference discharging rate Qref can be calculated by using the following Expression (1)

[Expression 1]

$$Q\mathrm{ref}=\pi d^2 * A\cdot\sqrt{2\Delta P1/\rho} \quad (1)$$

wherein each value is defined as follows:

π: circular constant;

d: hole diameter (m) of the reference orifice 59;

A: flow rate coefficient;

ΔP1: first pressure difference [Pa]; and

ρ: air density [g/m$^3$].

The flow rate coefficient A is a correction factor that converts a theoretical flow rate to an actual flow rate. The flow rate coefficient A is a variable set in accordance with a change in the closed system internal pressure Pit. The first pressure difference ΔP1 is a difference (Patm−Pit) between the atmospheric pressure Patm and the closed system internal pressure Pit. The air density ρ is calculated by using the following Expression (2).

[Expression 2]

$$\rho=P\mathrm{atm}/R*(To+273.15) \quad (2)$$

wherein each value is defined as follows:

Patm: atmospheric pressure [Pa];

R: dry air gas constant (=2.87);

To: ambient temperature [° C.]; and 273.15: value used to convert a degree Celsius to an absolute temperature.

As described above, the reference discharging rate Qref of gas in the closed system space can be calculated by using Expressions (1) and (2).

During a period from t12 to t14 and later (abnormality diagnosis period) shown in FIGS. 5A to 5D, the abnormality diagnostic processing is executed. During this abnormality diagnostic processing, the switching valve 53 of the diagnostic module 49 is on and the canister 15 is thus shut off from the air (see FIG. 1C). Under this condition, the negative pressure pump 51 sucks gas. Due to this suction, the closed system internal pressure Pit, which is a detection value of the internal pressure sensor 55, gradually decreases over time to a value below the reference pressure Pref, which is less than the atmospheric pressure Patm.

During the first period, which is defined as a period from t12 to t13 of the period t12 to t14 and later (abnormality diagnosis period), pressure-reducing treatment is carried out such that the negative pressure pump 51 is used to suck gas present in the closed system space in which the closed system internal pressure Pit has been reset to the atmospheric pressure Patm. The first period is a reserved period so as to prevent the occurrence of an error in the estimated volume of the closed system space. The purpose of this first period (reserved period) is described in detail below.

During the second period, which is defined as a period from t13 to t14 of the period t12 to t14 and later (abnormality diagnosis period), the following Expression (3) is used to calculate a first estimation value SV1 for the closed space volume $SV_{tg}$ by using the reference discharging rate Qref and the second pressure difference ΔP2, which is a difference between the first pressure P1 and the second pressure P2, each pressure being the closed system internal pressure Pit, before and after the pressure-reducing treatment of the closed fuel vapor system for a predetermined unit time Δt (=|t13−t14|; see FIG. 5B) by means of continuous action of the negative pressure pump 51.

[Expression 3]

$$SV1=(P\mathrm{atm}/\Delta P2)*Q\mathrm{ref}*\Delta t \quad (3)$$

wherein each value is defined as follows:

SV1: first estimation value (m$^3$) for the closed system space volume $SV_{tg}$;

Patm: atmospheric pressure [Pa];

ΔP2: second pressure difference=P1−P2 [Pa];

Qref: reference discharging rate [L/sec]; and

Δt: unit time=|t13−t14| [sec].

Next, an abnormality of the fuel level sensor 31 is diagnosed based on whether or not the first estimation value SV1 for the closed system space volume $SV_{tg}$ converges within a permissible volume range $SV_{th}$ defined by the first volume threshold $SV_{th1}$ and the second volume threshold $SV_{th2}$ (provided that $SV_{th1}<SV_{th2}$).

The closed system space volume $SV_{tg}$ correlates with a flow volume when the gas is subject to the pressure-reducing treatment (=the reference discharging rate Qref multiplied by the unit time Δt), provided that there is no abnormality (e.g., a leak, clogging) in the closed fuel vapor system.

Then, the gas flow volume when the gas is subject to the pressure-reducing treatment is calculated and the calculated value is multiplied by a pressure ratio (the atmospheric pressure Patm/the second pressure difference ΔP2) to give the first estimation value SV1 for the closed system space volume $SV_{tg}$.

Note that the permissible volume range $SV_{th}$ refers to a numerical range used when an abnormality of the fuel level sensor 31 is diagnosed based on the first estimation value SV1 for the closed system space volume $SV_{tg}$. The permissible volume range $SV_{tg}$ may be set such that the full fuel level detection value $LV_{ls_h}$ is a median and an appropriate margin is added to or subtracted from this median.

In Example 1, the first estimation value SV1 for the closed system space volume $SV_{tg}$ converges within the permissible volume range $SV_{th}$. Thus, the abnormality diagnosing unit 69 of the ECU 17 diagnoses that the fuel level sensor 31 is not abnormal. Example 1 corresponds to a process flow of from (Step S12: Yes) via (Step S14: Yes) to (Step S15: diagnostic result: not abnormal) in FIG. 3.

[Purpose of First Period (Reserved Period)]

Figure 6A:
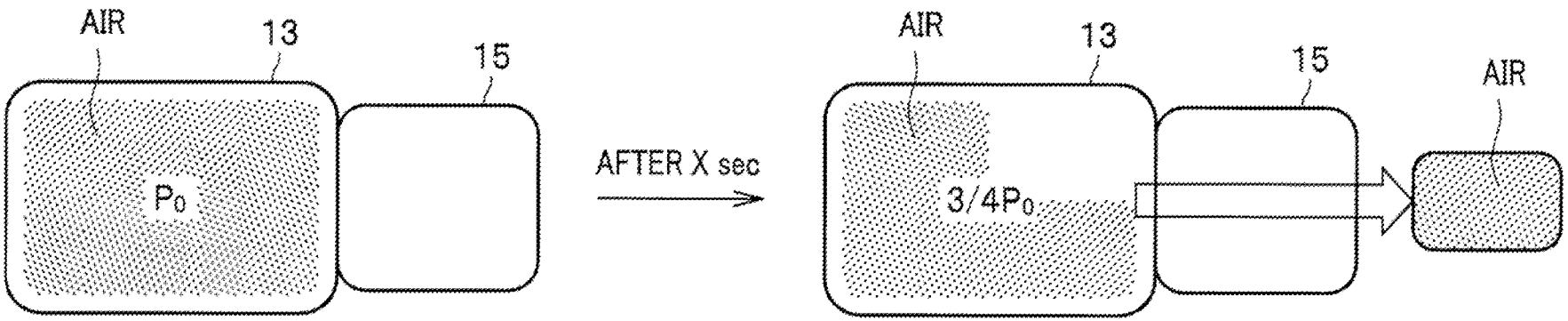
FIG. 6A is a schematic diagram illustrating a mechanism of causing a change in a closed system internal pressure when the closed system space is subjected to pressure-reducing treatment for a predetermined period by means of a negative pressure pump in the case where fuel vapor is absent in a fuel tank.
Figure 6B:
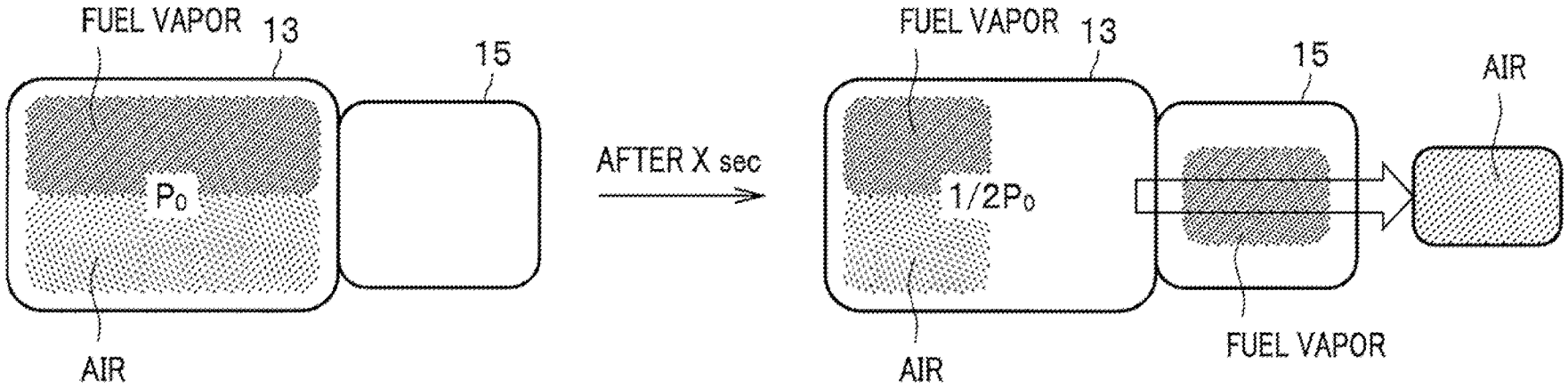
FIG. 6B is a schematic diagram illustrating a mechanism of causing a change in a closed system internal pressure when the closed system space is subjected to pressure-reducing treatment for a predetermined period by means of the negative pressure pump in the case where fuel vapor is present in the fuel tank.
Figure 6C:
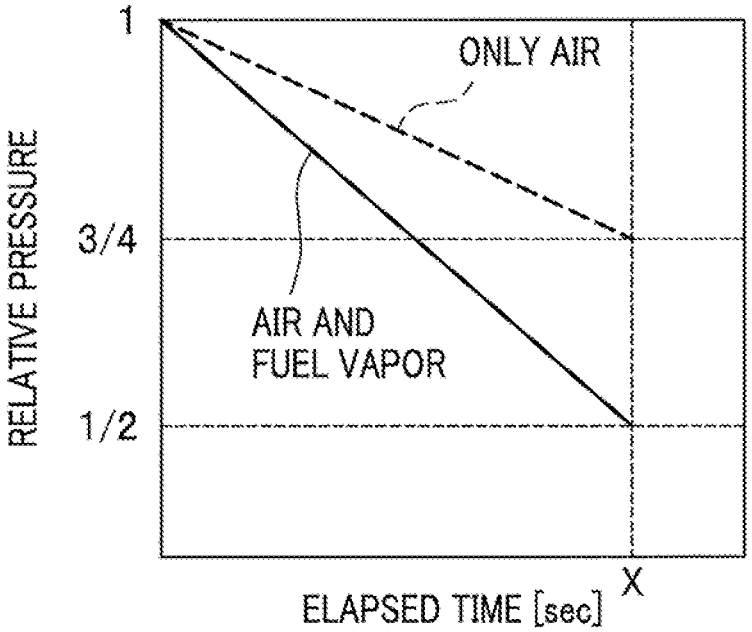
FIG. 6C is a graph in which a change in the closed system internal pressure over time in the case where fuel vapor is present in a fuel tank is compared with a change in the closed system internal pressure over time in the case where fuel vapor is absent in the fuel tank.

With reference to FIGS. 6A to 6C, the following describes the purpose of the first period (reserved period) defined as a period from t12 to t13.

FIG. 6A is a schematic diagram illustrating a mechanism of causing a change in the closed system internal pressure Pit when the closed system space is subjected to pressure-reducing treatment for a predetermined period by means of the negative pressure pump 51 in the case where fuel vapor is absent in the fuel tank 13. FIG. 6B is a schematic diagram illustrating a mechanism of causing a change in the closed system internal pressure Pit when the closed system space is subjected to pressure-reducing treatment for a predetermined period by means of the negative pressure pump 51 in the case where fuel vapor is present in the fuel tank 13. FIG. 6C is a graph in which a change in the closed system internal pressure Pit over time in the case where fuel vapor is present in the fuel tank 13 is compared with a change in the closed system internal pressure Pit over time in the case where fuel vapor is absent in the fuel tank 13.

Now, examined is the case where fuel vapor is absent in the fuel tank 13 (the fuel tank 13 is filled with air). As shown in FIG. 6A, the closed system internal pressure Pit is assumed to be "Po". Under this condition, the pressure of the closed system space (including the fuel tank 13, the vent passage 37, and the canister 15) was reduced for a given time (x sec) by the negative pressure pump 51.

In this case, as shown in FIG. 6A, a prescribed volume of air is discharged outside the closed system space after x sec. This is because the negative pressure pump 51 is a fixed discharging pump. This caused the closed system internal pressure Pit to decrease to "¾ Po" (see FIG. 6C). Here, the canister 15 fails to adsorb fuel vapor. This is because when the pressure of the closed system space is reduced, fuel vapor is absent in gas discharged outside the closed system space through the canister 15.

Now, examined is the case where fuel vapor is present in the fuel tank 13 (the fuel tank 13 is filled with mixed gas of air and fuel vapor). As shown in FIG. 6B, the closed system internal pressure Pit is likewise assumed to be "Po". Under this condition, the pressure of the closed system space was reduced for a given time (x sec) by the negative pressure pump 51.

In this case, as shown in FIG. 6B, a prescribed volume of air is discharged outside the closed system space after x sec. This is because the negative pressure pump 51 is a fixed discharging pump. In addition, fuel vapor is condensed (i.e., the volume is decreased) through adsorption on the canister 15. This is because when the pressure of the closed system space is reduced, the fuel vapor is present in gas discharged outside the closed system space through the canister 15. This caused the closed system internal pressure Pit to decrease to "½ Po" (see FIG. 6C).

In short, the rate of reducing the closed system internal pressure Pit in the case where fuel vapor is present in the fuel tank 13 is larger than the case where fuel vapor is absent in the fuel tank 13 (see FIG. 6C). As the concentration of the fuel vapor becomes higher, the rate of reducing the closed system internal pressure Pit tends to increase.

Accordingly, if the volume of the closed system space is estimated during the first period (reserved period) defined as a period from t12 to t13 while the concentration of the fuel vapor in the fuel tank 13 is high, for example, the estimated volume may be calculated as a relatively small value. In such a case, the estimated volume may not converge within the permissible volume range $SV_{th}$.

Consequently, when the determination "not abnormal" should be obtained, the misdiagnosis "abnormal" may be made depending on the concentration of the fuel vapor in the closed system space and/or the capacity state of adsorption of the fuel vapor on the canister 15.

Here, the present inventors conducted research and found that the case of the misdiagnosis was limited to an initial period (the first period) of the abnormality diagnosis period during which the abnormality was being diagnosed. This is because: since the capacity of adsorption of the fuel vapor on the canister 15 is limited, the fuel vapor cannot be adsorbed any more after the adsorption capacity is saturated; and when the concentration of the fuel vapor in the fuel tank 13 is high in the first place, the capacity of adsorption of the fuel vapor on the canister 15 should be almost saturated.

In short, it has been found that if the initial first period of the abnormality diagnosis period is set as a reserved period and the abnormality is diagnosed during the following second period, it is possible to avoid the misdiagnosis. The above has described the purpose of the first period (reserved period) defined as the period from t12 to t13.

Example 2 (Diagnostic Result: Abnormal)

First, FIGS. 5E to 5H are used to explain the time course of operation in Example 2 (diagnostic result: abnormal).

In Example 2, the fuel level sensor 31 indicates, like Example 1, the full fuel level detection value $LV_{ls_h}$.

During a period from t21 to t22 shown in FIGS. 5E to 5H, the reference discharging rate Qref is calculated. During this calculation, the switching valve 53 of the diagnostic module 49 is off and the canister 15 is thus in communication with the air (see FIG. 1B). Under this condition, the negative pressure pump 51 sucks gas. Due to this suction, the internal pressure sensor 55 detects a reference pressure Pref, which is less than the atmospheric pressure Patm (see, for example, FIG. 5F). Note that the reference discharging rate Qref can be calculated by using the above Expressions (1) and (2).

During a period from t22 to t24 and later (abnormality diagnosis period) shown in FIGS. 5E to 5H, the abnormality diagnostic processing is executed. During this abnormality diagnostic processing, the switching valve 53 of the diagnostic module 49 is on and the canister 15 is thus shut off from the air (see FIG. 1C). Under this condition, the negative pressure pump 51 sucks gas. Due to this suction, the closed system internal pressure Pit, which is a detection value of the internal pressure sensor 55, gradually decreases over time to a value below the reference pressure Pref, which is less than the atmospheric pressure Patm.

During the first period, which is defined as a period from t22 to t23 of the period t22 to t24 and later (abnormality diagnosis period), pressure-reducing treatment is carried out such that the negative pressure pump 51 is used to suck gas present in the closed system space in which the closed system internal pressure Pit has been reset to the atmospheric pressure Patm. The first period is a reserved period so as to prevent the occurrence of an error in the estimated volume of the closed system space.

During the second period, which is defined as a period form t23 to t24 of the period t22 to t24 and later (abnormality diagnosis period), the following Expression (4) is used, like Example 1, to calculate a second estimation value SV2 for the closed space volume $SV_{tg}$ by using the reference discharging rate Qref and the second pressure difference ΔP2, which is a difference in the closed system internal pressure Pit before and after the pressure-reducing treatment of the closed fuel vapor system for a predetermined unit time Δt (=|t23−t24|; see FIG. 5F) by means of continuous action of the negative pressure pump 51.

[Expression 4]

$$SV2=(P\text{atm}/\Delta P2)*Q\text{ref}*\Delta t \quad (4)$$

wherein each value is defined as follows:

SV2: second estimation value ($m^3$) for the closed system space volume $SV_{tg}$;

Patm: atmospheric pressure [Pa];

ΔP2: second pressure difference=P1−P2 [Pa];

Qref: reference discharging rate [L/sec]; and

Δt: unit time=|t23−t24| [sec].

Next, an abnormality of the fuel level sensor 31 is diagnosed based on whether or not the second estimation value SV2 for the closed system space volume $SV_{tg}$ converges within the permissible volume range $SV_{th}$.

In Example 2, the second estimation value SV2 for the closed system space volume $SV_{tg}$ fails to converge within the permissible volume range $SV_{th}$. Thus, the abnormality diagnosing unit 69 of the ECU 17 diagnoses that the fuel level sensor 31 is abnormal. Example 2 corresponds to a process flow of from (Step S12: Yes) via (Step S14: No) to (Step S16: diagnostic result: abnormal) in FIG. 3.

[Advantageous Effects of Fuel Level Estimation Device 11 According to Embodiment of the Present Invention]

The following describes advantageous effects of the fuel level estimation device 11 according to an embodiment of the present invention.

The fuel level estimation device 11 according to the first aspect includes: the information acquiring unit 65 configured to acquire information about the closed system internal pressure Pit of the closed fuel vapor system including the fuel tank 13 that stores fuel, the vent passage 37 through which the fuel tank 13 is in communication with air, and the canister 15 used to adsorb fuel vapor generated in the fuel tank 13; the flow rate controlling unit (controlling unit) 71 configured to control, by actuating the negative pressure pump (negative pressure source) 51, a flow rate of fuel vapor-containing gas present in the closed fuel vapor system; and the fuel level estimating unit 67 configured to estimate a fuel level $V_{fl}$ based on a total volume (whole closed system volume) $SV_{wl}$ of the closed fuel vapor system and an occupied volume (closed system space volume) $SV_{tg}$ of the gas.

In the fuel level estimation device 11 according to the first aspect, the fuel level estimating unit 67 estimates the occupied volume (closed system space volume) $SV_{tg}$ of the gas by using the reference discharging rate Qref when the gas is subject to the pressure-reducing treatment and the change Δp2 in the closed system internal pressure Pit before and after the closed fuel vapor system is subjected to the pressure-reducing treatment for the predetermined unit time Δt by means of the flow rate controlling unit 69.

According to the fuel level estimation device 11 based on the first aspect, the fuel level $V_{fl}$ is estimated based on the total volume (whole closed system volume) $SV_{wl}$ of the closed fuel vapor system and the occupied volume (closed system space volume) $SV_{tg}$ of the gas. This makes it possible to estimate, with high precision, the level $V_{fl}$ of fuel in the fuel tank 13 regardless of refueling.

[Advantageous Effects of Abnormality Diagnostic Apparatus 10 for Closed Fuel Vapor System According to Embodiment of the Present Invention]

The following describes advantageous effects of the abnormality diagnostic apparatus 10 for a closed fuel vapor system according to an embodiment of the present invention.

The abnormality diagnostic apparatus 10 for a closed fuel vapor system according to the second aspect includes: the information acquiring unit 65 configured to acquire information about a fuel level detection value $LV_{ls}$ detected by the fuel level sensor 31 and information about the closed system internal pressure Pit of the closed fuel vapor system including the fuel tank 13 that stores fuel, the vent passage 37 through which the fuel tank 13 is in communication with air, and the canister 15 used to adsorb fuel vapor generated in the fuel tank 13; the flow rate controlling unit (controlling unit) 71 configured to control, by actuating the negative pressure pump (negative pressure source) 51, a flow rate of fuel vapor-containing gas present in the closed fuel vapor system; the fuel level estimating unit 67 configured to estimate a fuel level $V_{fl}$ based on a total volume (whole closed system volume) $SV_{wl}$ of the closed fuel vapor system and an occupied volume (closed system space volume) $SV_{tg}$ of the gas; and the abnormality diagnosing unit 69 configured to diagnose an abnormality of the closed fuel vapor system.

In the abnormality diagnostic apparatus 10 for a closed fuel vapor system according to the second aspect, the fuel level estimating unit 67 estimates the occupied volume (closed system space volume) $SV_{tg}$ of the gas by using the reference discharging rate Qref when the gas is subject to the pressure-reducing treatment and the change Δp2 in the closed system internal pressure Pit before and after the closed fuel vapor system is subjected to the pressure-reducing treatment for the predetermined unit time Δt by means of the flow rate controlling unit 71. The abnormality diagnosing unit 69 diagnoses an abnormality of the fuel level sensor 31 on the basis of the fuel level detection value $LV_{ls}$ detected by the fuel level sensor 31 and the fuel level estimation value $LV_{es}$ obtained by the fuel level estimating unit 67.

According to the abnormality diagnostic apparatus 10 based on the second aspect, the abnormality diagnosing unit 69 diagnoses an abnormality of the fuel level sensor 31 by using the fuel level detection value $LV_{ls}$ detected by the fuel level sensor 31 and the fuel level estimation value $LV_{es}$ obtained, by the fuel level estimating unit 67, based on, for example, the occupied volume (closed system space volume) $SV_{tg}$ of fuel vapor-containing gas present in the closed fuel vapor system. This makes it possible to estimate, with high precision, the level $V_{ft}$ of fuel in the fuel tank 13 regardless of refueling and to accurately diagnose an abnormality of the fuel level sensor 31.

In addition, the abnormality diagnostic apparatus 10 according to the third aspect is the abnormality diagnostic apparatus 10 according to the second aspect, wherein the fuel level sensor 31 has an insensitive region where an actual change in the fuel level $V_{ft}$ disagrees with a change in the fuel level detection value $LV_{ls}$; and when the fuel level detection value $LV_{ls}$ is a value corresponding to the insensitive region, the abnormality diagnosing unit 69 diagnoses an abnormality of the fuel level sensor 31 on the basis of the fuel level detection value $LV_{ls}$ detected by the fuel level sensor 31 and the fuel level estimation value $LV_{es}$ obtained by the fuel level estimating unit 67.

According to the abnormality diagnostic apparatus 10 based on the third aspect, when the fuel level detection value $LV_{ls}$ is a value corresponding to the insensitive region where the $LV_{ls}$ disagrees with an actual change in the fuel level $V_{ft}$, an abnormality of the fuel level sensor 31 is diagnosed on the basis of the fuel level detection value $LV_{ls}$ detected by the fuel level sensor 31 and the fuel level estimation value $LV_{es}$ obtained by the fuel level estimating unit 67. Hence, in addition to the effects of the abnormality diagnostic apparatus 10 according to the second aspect, it is possible to avoid a misdiagnosis of the fuel level sensor 31, which misdiagnosis may occur when the fuel level detection value $LV_{ls}$ is a value corresponding to the insensitive region. This point can contribute to increasing reliability of the fuel level sensor 31.

Other Embodiments

The above-described embodiments are examples to be embodied in the present invention. Accordingly, they should not be construed such that the technical scope of the present invention is limited. This is because the present invention can be put into practice, without departing from the sprite and the main features thereof, even in various embodiments.

For instance, it is described in one of the embodiments of the present invention that the vent passage 37 is provided with the sealing valve 41. However, the present invention is not limited to this embodiment. The sealing valve 41 may be omitted.

In addition, it is described that one of the embodiments of the present invention includes the atmospheric pressure sensor 58. However, the present invention is not limited to this embodiment. The atmospheric pressure sensor 58 may be omitted. In this case, the internal pressure 55 may be used to detect the atmospheric pressure Patm because when the switching valve 53 is switched to the air communication side, which causes the canister 15 to be in communication with the air (see FIG. 1B), the internal pressure sensor 55 detects the atmospheric pressure Patm.

In addition, the case is illustrated where the fuel level sensor 31 indicates the full fuel level detection value $LV_{ls_h}$ in the description of Examples 1 and 2 according to the present invention. However, the present invention is not limited to this case. The present invention should be applicable to the case where the fuel level sensor 31 indicates the lowest fuel level detection value $LV_{ls_l}$. In this case, the permissible volume range $SV_{tg}$ may be set such that the lowest fuel level detection value $LV_{ls_l}$ is a median and an appropriate margin is added to or subtracted from this median.

In addition, in the description of the embodiments according to the present invention, the case is illustrated where the fuel level estimation device 11 according to one embodiment of the present invention is used for a hybrid vehicle equipped with an internal-combustion engine and an electric motor as driving sources. However, the present invention is not limited to this case. The present invention may be applicable to each vehicle equipped with only an internal-combustion engine as a driving source.

REFERENCE SIGNS LIST

10 Abnormality diagnostic apparatus
11 Fuel level estimation device
13 Fuel tank
15 Canister
37 Vent passage
51 Negative pressure pump (negative pressure source)
65 Information acquiring unit
67 Fuel level estimating unit
69 Abnormality diagnosing unit
71 Controlling unit (flow rate controlling unit)

The invention claimed is:

1. A fuel level estimation device comprising:

an information acquiring unit configured to acquire information about a closed system internal pressure of a closed fuel vapor system including a fuel tank that stores fuel, a vent passage through which the fuel tank is in communication with air, and a canister used to adsorb fuel vapor generated in the fuel tank;

a flow rate controlling unit configured to control, by actuating a negative pressure source, a flow rate of fuel vapor-containing gas present in the closed fuel vapor system; and a fuel level estimating unit configured to estimate a fuel level based on a total volume of the closed fuel vapor system and an occupied volume of the gas, wherein the fuel level estimating unit estimates the occupied volume of the gas on the basis of a change in the closed system internal pressure before and after the closed fuel vapor system is subjected to pressure-reducing treatment for a predetermined unit time by means of the flow rate controlling unit and a reference discharging rate when the gas is subject to the pressure-reducing treatment.

2. An abnormality diagnostic apparatus for a closed fuel vapor system, comprising:

an information acquiring unit configured to acquire information about a fuel level detection value detected by a fuel level sensor and information about a closed system internal pressure of a closed fuel vapor system including a fuel tank that stores fuel, a vent passage through which the fuel tank is in communication with air, and a canister used to adsorb fuel vapor generated in the fuel tank;

a flow rate controlling unit configured to control, by actuating a negative pressure source, a flow rate of fuel vapor-containing gas present in the closed fuel vapor system;

a fuel level estimating unit configured to estimate a fuel level based on a total volume of the closed fuel vapor system and an occupied volume of the gas; and an abnormality diagnosing unit configured to diagnose an abnormality of the closed fuel vapor system, wherein the fuel level estimating unit estimates the occupied volume of the gas on the basis of a change in the closed system internal pressure before and after the closed fuel vapor system is subjected to pressure-reducing treatment for a predetermined unit time by means of the flow rate controlling unit and a reference discharging rate when the gas is subject to the pressure-reducing treatment; and the abnormality diagnosing unit diagnoses an abnormality of the fuel level sensor on the basis of the fuel level detection value and a fuel level estimation value obtained by the fuel level estimating unit.

3. The abnormality diagnostic apparatus for a closed fuel vapor system according to claim 2, wherein the fuel level sensor has an insensitive region where an actual change in the fuel level disagrees with a change in the fuel level detection value; and the abnormality diagnosing unit diagnoses the abnormality of the fuel level sensor in at least the insensitive region by using the fuel level detection value detected by the fuel level sensor and the fuel level estimation value obtained by the fuel level estimating unit.

* * * * *